United States Patent [19]

Etheridge

[11] Patent Number: 4,850,923

[45] Date of Patent: Jul. 25, 1989

[54] FLYING TOY

[76] Inventor: Ronald D. Etheridge, 170 Gaines Ct., Athens, Ga. 30605

[21] Appl. No.: 191,156

[22] Filed: May 6, 1988

[51] Int. Cl.[4] ..... A63H 27/00; A63B 65/10

[52] U.S. Cl. ..... 446/34; 273/424

[58] Field of Search ..... 446/34; 273/424, 425

[56] References Cited

U.S. PATENT DOCUMENTS

| | | | |
|---|---|---|---|
| 3,264,776 | 8/1966 | Morrow | 446/34 |
| 3,594,945 | 7/1971 | Turney | 273/425 |
| 3,982,489 | 9/1976 | Flatau et al. | 446/34 |
| 4,151,674 | 5/1979 | Klahn et al. | 446/34 |
| 4,329,807 | 5/1982 | Atkinson | 273/425 |
| 4,456,265 | 6/1984 | Adler | 273/425 |

*Primary Examiner*—Robert A. Hafer
*Assistant Examiner*—Michael Brown
*Attorney, Agent, or Firm*—Wigman & Cohen

[57] ABSTRACT

A flying toy with a hollow cylinder having an annular side wall with a leading end and a trailing end and an inner and an outer surface is formed so that the outer surface of the side wall at the leading end of the cylinder has an airfoil shape, so that a lift is generated on the outer surface of the side wall of the cylinder as the cylinder travels through the air.

13 Claims, 1 Drawing Sheet

FIG. 1
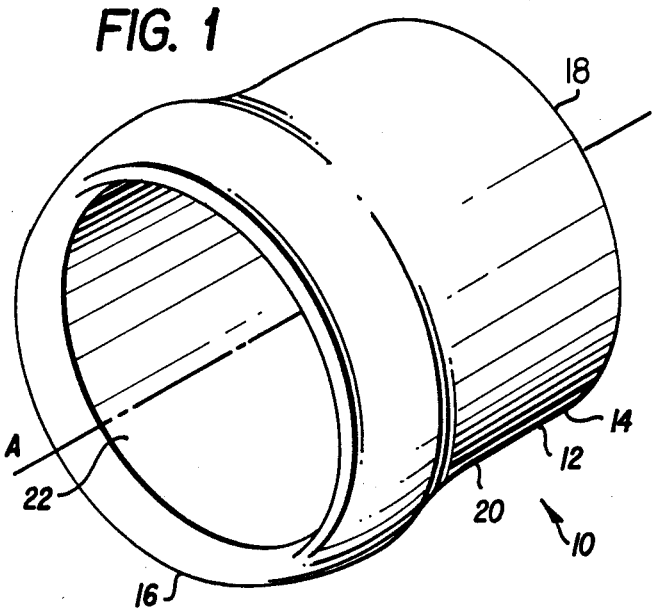
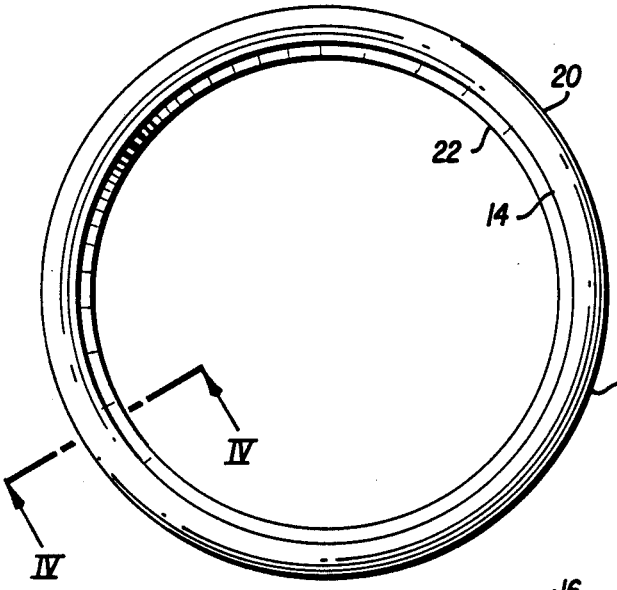
FIG. 2
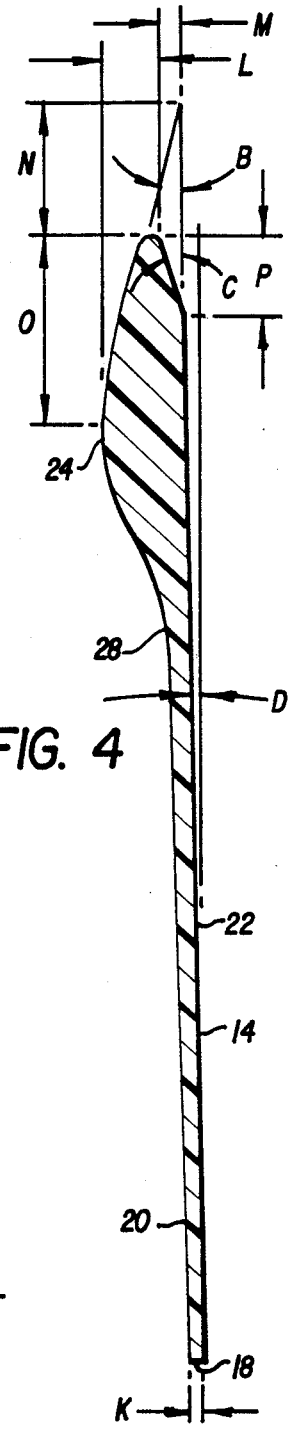
FIG. 4
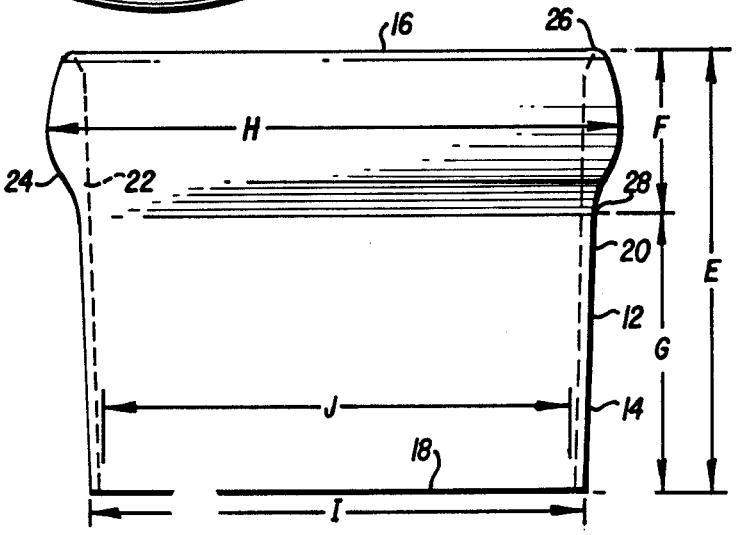
FIG. 3

FLYING TOY

BACKGROUND OF THE INVENTION

The present invention relates to flying toys and more particularly to a flying toy having a hollow cylindrical shape.

A search of the prior art failed to uncover any prior art references which disclose the flying toy of the present invention. A number of patents were uncovered which disclose flying cylinders. The following is a listing of the patents uncovered during the aforementioned search:

| U.S. Pat. No. | Patentee | Issue Year |
|---|---|---|
| 2,683,603 | Gackenbach | 1954 |
| 3,264,776 | Morrow | 1966 |
| 4,003,574 | MacDonald et al | 1977 |
| 4,151,674 | Klahn et al | 1979 |
| 4,246,721 | Bowers | 1981 |
| 4,339,138 | DiManno | 1982 |

Of the aforementioned patents, Morrow discloses an aerial toy comprising a cylindrical tube 10 having a weighted end which exhibits airfoil characteristics. Morrow does not recognize, however, that the cross-sectional shape of the leading edge of the flying cylinder can make a significant contribution to the flying characteristics of the device. Rather, Morrow only teaches that weighting of the leading end of the cylinder is the factor by which the device exhibits airfoil characteristics. As recognized by the subsequent patent to Klahn et al, while the flying cylinder of Morrow exhibits certain desirable flying characteristics when properly thrown, the lift to drag ratio of the device is sufficiently low that the flying cylinder does not fly well enough to provide an attractive amusement device.

Klahn et al disclose a flying cylinder which comprises a body and a boundary layer tripping mechanism at the leading end. The flying cylinder of Klahn et al is constructed of two pieces of thin sheet metal which are crimped at the leading end of the cylinder to form a ledge. This ledge provides the boundary layer tripping mechanism which results in turbulent air flow when the cylinder is thrown through the air. The flying cylinder of Klahn et al is constructed from a conventional aluminum beverage container from which one can end and a cylindrical portion of the side wall of the container, including the other can end, is cut and removed. There are several limitations and shortcomings of the flying cylinder of Klahn et al. The design of the device relies on turbulent air flow for flight. The velocity of a turbulent air flow at a given point varies erratically in magnitude and direction. Because the construction of the device is based on a can, it would be difficult to manufacture the device to include the many irregularities resulting from construction of the device by hand. Further, because the construction of the device is based on a can, it would be difficult to manufacture the device in a manner other than that in which cans are produced. Only a select number of cans have the correct weight distribution and other characteristics to fly. The labor costs involved in producing the flying cylinder from a can are prohibitive, and the safety of a metal can flying device is questionable. The durability of such a device is also limited, since it can easily be destroyed, for example, by inadvertently stepping on the device.

SUMMARY AND OBJECTS OF THE INVENTION

In view of the foregoing limitations and shortcomings of the prior art devices, as well as other disadvantages not specifically mentioned above, it is a primary objective of this invention to provide a flying cylinder toy which has improved flying characteristics.

More particularly, it is an object of this invention to provide a flying cylinder toy having an attractive, aerodynamic design.

Another object of the invention is to provide a flying cylinder toy that is easy for persons of all ages to throw, making it an attractive and enjoyable throwing toy.

It is another object of this invention to provide a flying cylinder toy which is economical to manufacture.

Yet another object of this invention is to provide a flying cylinder toy which is extremely durable.

Still another object of this invention is to provide a flying cylinder toy which is safe to use and is not dangerous even to small children.

Briefly described, the aforementioned objects are accomplished according to the invention by providing a flying toy device which comprises a hollow cylinder having an annular side wall with leading and trailing ends. The outer surface of the side wall at the leading end of the cylinder has an airfoil shape, so that a lift is generated on the outer surface of the side wall of the cylinder as the cylinder travels through the air. The airfoil shape is smooth and streamlined from the tip of the leading end to the merger of the airfoil shape with the outer surface of the cylindrical side wall. The outer airfoil surface of the side wall at the leading end is inclined outwardly toward the trailing end at an angle substantially equal to 16° with respect to the inner surface of the side wall. Also, the inner surface of the side wall at the leading end is inclined outwardly toward the leading end with respect to the inner surface of the side wall at an angle substantially equal to 16°. The ratio of the weight of the leading end portion to the weight of the trailing end portion is substantially equal to 2.5.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 is a perspective view of the flying cylinder in accordance with the present invention.

FIG. 2 is a leading end view of the flying cylinder in accordance with the present invention.

FIG. 3 is a partly broken side elevational view of the flying cylinder in accordance with the present invention.

FIG. 4 is a sectional view taken along line IV—IV of FIG. 2, illustrating the cross-sectional shape of the side wall of the flying cylinder in accordance with the present invention.

DETAILED DESCRIPTION OF THE PREFERRED EMBODIMENTS

Referring now in detail to the drawings wherein like parts are designated by like reference numerals throughout, there is illustrated in FIGS. 1 through 3 a flying cylinder toy which is designated generally by reference numeral 10. Flying cylinder 10 comprises a hollow cylindrical body 12 having an annular side wall 14 which is concentrically arranged about a central longitudinal axis A—A, and which has a leading end 16 and a trailing end 18. Flying cylinder 10 is launched by holding it in the hand of the user and throwing it with a flick of the wrist so that cylinder 10 moves generally parallel to the central longitudinal axis A—A and rotates about this axis. In this manner, flying cylinder 10 is propelled through the air in a manner similar to that described in the above-discussed prior art patents.

Annular side wall 14 has an outer surface 20 and an inner surface 22. At the leading end 16 of hollow cylinder 12, the outer surface 20 has a cross sectional shape which is in the shape of an airfoil, generally indicated at reference numeral 24. Airfoil shape 24 is smooth and streamlined from the forward extent or tip 26 of leading end 16 to the position or plane 28 where airfoil shape 24 merges with the remainder of outer surface 20 of annular side wall 14. Thereafter, from position 28 to the end of trailing end 18, outer cylindrical surface 20 has a substantially constant diameter. Outer surface 20, having the shape thus described, is a particularly advantageous aspect of the present invention.

Because of the airfoil shape of outer surface 20, a lift is created similar to that produced across a wing, improving the flying characteristics of the hollow cylinder. Furthermore, since the airfoil is smooth and streamlined, the flow across the outer surface is non-turbulent and laminar, which further improves the lift to drag ratio of the flying cylinder. The airfoil shape of the invention further provides the optimum weight distribution for the flying cylinder, in which the ratio of the weight of the leading portion between tip 26 and plane 28 to the weight of the trailing portion between plane 28 and end 18 equals about 2.5.

Referring now to FIG. 4, further details of the inventive shape of annular side wall 14 are illustrated. In particular, the outer surface 20 or airfoil shape of side wall 14 at the leading end 16 of the device is set at an angle B with respect to the inner surface 22 of side wall 14. This angle B is inclined outwardly toward the trailing end 18 and is substantially equal to 16°. It has been found that an angle of about 16° is the preferred angle for the leading portion of the convex curvature on outer surface 20. A tangles greater than about 16° the result is stalling of the hollow cylinder, while at angles less than about 16° the result is less than optimum flight characteristics of the hollow cylinder.

It has also been found that for optimum flying characteristics, the ratio of the length of the trailing end to the length of the airfoil shape, or the ratio of G/F, as shown in FIG. 4, be substantially equal to 1.68, and the length to I.D. ratio, or the ratio of E/J, as shown in FIG. 4, be substantially equal to 0.89.

Referring now to inner surface 22 of side wall 14, it will be seen that inner surface 22 presents a generally linear cross-sectional shape along substantially its entire length. However, the leading end of inner surface 22 is set at an angle C which is inclined outwardly toward the leading end 16 and is also substantially equal to about 16°. The provision of the angle C has also been found to enhance the flying characteristics of the flying cylinder. The tip 26 of leading end 16 is rounded between the outer surface 20 and the inner surface 22, so as to present a streamlined flying shape and to provide a safe toy which does not have sharp edges. Further, inner surface 22 of side wall 14 is tapered slightly inwardly from the enlarged leading end 16 to the substantially constant diameter, thinner trailing end 18. This taper is illustrated in FIG. 4 as angle D, and in the preferred embodiment is substantially equal to 1°. Further, there is also a 1° taper on the outside of the trailing end.

Referring now to FIGS. 3 and 4, the dimensions of a flying cylinder toy 10 according to an actual embodiment of the invention are set forth in the following tabulation:

DIMENSIONS

| | |
|---|---|
| E | 1.8125" |
| F | .675" |
| G | 1.137" |
| H | 2.375" |
| I | 2.1008" |
| J | 2.0618" |
| K | .0195" |
| L | .125" |
| M | .0316" |
| N | .200" |
| O | .240" |
| P | .140" |
| Q | .0195" |

The above dimensions are not intended to limit the scope of the invention, but are intended to set forth a presently preferred embodiment of the invention.

The flying cylinder 10 of the invention is readily manufactured in a unitary, one-piece construction by injection molding the device in a single operation from a suitable plastic material such as a lightweight, tough, flexible nylon. While nylon is used in the preferred embodiment, it will be appreciated that many other materials may be used consistent with the intended use of the present invention, such as polypropylene and polyethylene.

The flying cylinder 10 according to the present invention is a perfectly balanced design which imparts a natural spin when thrown and does not require additional weights, ridges, or apertures for a stable flight pattern.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. A flying device comprising:

a hollow cylinder having an annular side wall, said cylinder having a leading end and a trailing end, said side wall having an inner surface and an outer surface;

said outer surface of the side wall at the leading end of the cylinder comprising airfoil means for generating lift on the outer surface of the side wall of the cylinder as the cylinder travels through the air;

wherein said airfoil means comprises an airfoil shape having a leading surface inclined outwardly with respect to the central longitudinal axis of said device at an angle of about 16° toward the trailing end, the inner surface of the side wall at the leading end being disposed at an angle of about 16° inclined outwardly with respect to the central longitudinal axis of said device toward the leading end, said hollow cylinder being molded of plastic in a unitary, one-piece construction.

2. The flying device of claim 1 wherein the ratio of the length of the trailing end to the length of the airfoil shape is substantially equal to 1.68 and the ratio of the total length to the inside diameter is substantially equal to 0.89.

3. A flying device comprising:

a hollow cylinder having an annular side wall, said cylinder having a leading end and a trailing end, said side wall having an inner surface and an outer surface;

said outer surface of the side wall at the leading end of the cylinder having an airfoil shape, whereby a lift is generated on the outer surface of the side wall of the cylinder as the cylinder travels through the air;

wherein the outer surface of the side wall at the leading end is set at an angle with respect to the inner surface of the side wall at the trailing end, said angle being inclined outwardly toward the trailing end;

wherein the inner surface of the side wall at the leading end is set at an angle inclined outwardly with respect to the central longitudinal axis of the device toward the leading end and being substantially equal to 16°.

4. The flying device of claim 3 wherein said airfoil shape is smooth and streamlined from the forward extent of the leading end to the merger of said airfoil shape with the remainder of the outer surface of the side wall at a position intermediate the leading end and the trailing end.

5. The flying device of claim 4 wherein said angle at which the outer surface of the side wall at the leading end is set with respect to the inner surface of the side wall at the trailing end, said angle being inclined outwardly toward the trailing end, is substantially equal to 16°.

6. The flying device of claim 4 wherein the ratio of the weight of the leading end up to said merger of the airfoil shape and the remainder of the outer surface to the weight of the trailing end up to said merger is substantially equal to 2.5.

7. The flying device of claim 3 wherein said hollow cylinder is of unitary, one-piece construction fabricated from a plastic material.

8. The flying device of claim 7 wherein said plastic material is nylon, polypropylene, or polyethylene.

9. The flying device of claim 3 wherein said angle at which the outer surface of the side wall at the leading end is set with respect to the inner surface of the side wall at the trailing end is substantially equal to 16°.

10. The flying device of claim 3 wherein the inner surface of the side wall is tapered inwardly with respect to the central longitudinal axis of the device at an angle substantially equal to 1° from the leading end to the trailing end, along a substantial portion of the length of said inner surface.

11. The flying device of claim 3 wherein the ratio of the weight of leading end to the weight of the trailing end is substantially equal to 2.5.

12. The flying device of claim 3 wherein the forward extent of the leading end is rounded.

13. The flying device of claim 3 wherein the ratio of the length of the trailing end to the length of the airfoil shape is substantially equal to 1.68 and the ratio of the total length to the inside diameter is substantially equal to 0.89.

* * * * *